US006860743B2

(12) United States Patent
Ekkul et al.

(10) Patent No.: US 6,860,743 B2
(45) Date of Patent: Mar. 1, 2005

(54) ADAPTOR ASSEMBLY

(75) Inventors: Jessada Ekkul, Samutprakarn (TH); Bhumchai Chaisri, Samutprakarn (TH); James Lim Choo Soo, Samutprakarn (TW)

(73) Assignees: Delta Electronics, Inc., Taoyuan Shein (TW); Delta Electronics (Thailand) Public Ltd., Samutprakarn (TW)

( * ) Notice: Subject to any disclaimer, the term of this patent is extended or adjusted under 35 U.S.C. 154(b) by 15 days.

(21) Appl. No.: 10/406,103

(22) Filed: Apr. 2, 2003

(65) Prior Publication Data

US 2003/0219997 A1 Nov. 27, 2003

(30) Foreign Application Priority Data

Apr. 2, 2002 (TW) ..... 91106564 A

(51) Int. Cl.[7] ..... H01R 12/00

(52) U.S. Cl. ..... 439/76.1; 439/79; 439/263; 439/848

(58) Field of Search ..... 439/76.1, 79, 263, 439/848, 849, 80–81, 857, 876, 78, 357

(56) References Cited

U.S. PATENT DOCUMENTS 1,696,616 A * 12/1928 Wappler ..... 439/844
3,141,054 A * 7/1964 Francis ..... 264/255
3,902,153 A * 8/1975 Narozny ..... 439/844
4,394,059 A * 7/1983 Reynolds ..... 439/500
4,505,531 A * 3/1985 Miller ..... 439/246
4,674,809 A * 6/1987 Hollyday et al. ..... 439/92
4,684,202 A * 8/1987 House et al. ..... 439/752
5,636,999 A * 6/1997 Hirai et al. ..... 439/79
5,674,749 A * 10/1997 Chen et al. ..... 435/344.1
5,772,452 A * 6/1998 Aoyama ..... 439/74
5,779,492 A * 7/1998 Okuyama et al. ..... 439/179
5,800,186 A * 9/1998 Ramirez et al. ..... 439/74
6,114,933 A * 9/2000 Widiger et al. ..... 336/96

* cited by examiner

*Primary Examiner*—Tho D. Ta
*Assistant Examiner*—Larisa Tsukerman

(57) ABSTRACT

An adaptor assembly is provided. The adaptor assembly includes: a circuit board, a plug having a first engaging structure, securing structure fixed to the circuit board and having a second engaging structure for being electrically connected and engaging with the first engaging structure, and a housing for fixedly mounting thereon the plug. The provided adaptor assembly is able to minimize the volume of the adaptor by saving the internal space and simplify the assembly process by directly connecting the conductive terminal and the printed circuit board.

16 Claims, 9 Drawing Sheets

ADAPTOR ASSEMBLY

FIELD OF THE INVENTION

The present invention is related to an adaptor, and more particularly, to an adaptor assembly.

BACKGROUND OF THE INVENTION

Adaptors are very common household appliances. An adaptor could be the charger for a cell phone or the power supply for a walkman. Generally, an adaptor is widely used for different purposes. When the adaptor is used as a power adaptor, it can commutate the electric current and transform the current for the directly usage of the electric equipment. When the adaptor is used as a charger, it can recharge the rechargeable battery. Please refer to FIG. 1 is a diagram illustrating the conventional adaptor assembly structure according to the prior art. The conventional adaptor assembly includes an insulation housing 13, a plug 12, a printed circuit board 11, and a power connecting cord 66. The plug 12 is used for connecting with the external power supply. The printed circuit board 11 has different electrical elements or devices (not disclosed) mounted thereon in response to the different functions of different adaptors. The power connecting cord 66 is used for electrically connecting the printed circuit board 11 and the conductive terminal 15 at the end of the plug 12. In such a way, the external power can enter to the internal printed circuit board 11 through the conductive terminal 15 at the end of the plug 12 and the power connecting cord 66 so that the adaptor can perform the function.

Nowadays the electronic equipment is getting miniaturized, and this occurs in the adaptor field as well. However, when using the power connecting cord 66 to connect the printed circuit board 11 and the conductive terminal 15 at the end of the plug 12, the power connecting cord (conductive jumper) 66 must have quite long length for its two ends being fixedly welded on the printed circuit board 11 and the conductive terminal 15. Therefore, the power connecting cord 66 occupies large internal space of the adaptor, which largely lowers the possibility to reduce the volume of the adaptor. Furthermore, the power connecting cord 66 is connected to the printed circuit board 11 and the conductive terminal 15 by welding. Please refer to FIG. 1, one end of the power connecting cord 66 is firstly welded on the hole 150 at the conductive terminal 15, then the other end is welded on the printed circuit board 11. However, the conductive terminal 15 must be mounted on the insulation housing 13 before the welding process. Since the insulation housing 13 is a structure with five-sides hunt, the welding process is difficult to perform and hard to watch. The welding result is often not complete. Besides, during the welding process, the extremely high heat will be unavoidably conducted through the conductive terminal 15, which will easily damage the insulation housing 13 and the mounting situation of the conductive terminal 15, even make the whole insulation housing 13 unusable. Therefore, the welding process not only costs lots of time and energy in the whole assembly process for the adaptor, but also affects the structural quality after the assembly is accomplished.

In addition, the quite long length of the power connecting cord 66, which is necessary for conveniently executing the welding process, will be too long after the welding is accomplished. The extra length between the two welding points will be placed in a coiled shape inside the adaptor. In such a way, the power connecting cord 66 will unavoidably contact with the surrounding electronic elements. It is very possible to cause malfunction of the adaptor since the electronic elements are compressed in the limited space. Besides, a dangerous short circuit might occur if the insulation coating of the power connecting cord 66 is damaged during the compressive assembly process or the power connecting cord 66 has an insulation flaw in the first place. From the above description, it is known that under the trend towards smaller adaptor size, how to enhance the efficiency in the assembly manufacture process and simplify the assembly process in the economical concern for mass production in the industry have become a major problem waited to be solved.

In order to overcome the drawbacks in the prior art, an adaptor assembly is provided. The particular design in the present invention not only solves the problem that the power connecting cord occupies too much space inside the adaptor, but also simplifies the electrical connection process between the conductive terminal and the printed circuit board. Moreover, the assembly process is easy and economical to be executed and the quality of the assembly structure can be improved and further assured. Thus, the invention has the utility for the industry.

SUMMARY OF THE INVENTION

The main purpose of the present invention is to provide an adaptor assembly, which is able to reduce the internal space and minimize the volume of the adaptor.

It is one object of the present invention to provide an adaptor assembly, which is able to simplify the electrical connecting process between the conductive terminal and the printed circuit board so that the assembly process becomes easier and more convenient.

It is another object of the present invention to provide an adaptor assembly, which is able to connect the conductive terminal and the printed circuit board directly without the need of the power connecting cord. Not only the assembly process is simplified, but also a safer and more dependable adaptor structure is provided.

According to one aspect of the present invention, an adaptor assembly, comprises: a circuit board, a plug having a first engaging structure, a securing structure fixed to the circuit board and having a second engaging structure for being electrically connected and engaging with the first engaging structure, and a housing for fixedly mounting thereon the plug.

In accordance with the present invention, the circuit board is a printed circuit board.

Preferably, the plug comprises at least two the conductive terminals having the first engaging structure.

Preferably, the housing further comprises a flank structure having a wedging indentation for tightly wedging therein the securing structure so that the securing structure is tightly secured to the housing.

Preferably, the securing structure further comprises a bulge wedged in the wedged indentation for fixing the securing structure.

Preferably, the housing and the flank structure are integrally formed.

Preferably, the first engaging structure is a protrudent structure, and the second engaging structure of the securing structure is an indentation structure.

Preferably, the first engaging structure is an indentation structure, and the second engaging structure of the securing structure is a protrudent structure.

Preferably, the securing structure includes a pair of elastic pieces having symmetrical structures.

Preferably, the first engaging structure is a conductive terminal.

Preferably, the conductive terminal is an alternating current pin (AC pin).

Preferably, the housing has a insertion hole for inserting and fixedly mounting the conductive terminal thereon.

Preferably, the adaptor is a power adaptor.

Preferably, the adaptor is a power supply.

Preferably, the adaptor is a charger.

According to another aspect of the present invention, an adaptor assembly, comprises: a circuit board, a plug having a first engaging structure, a retaining structure fixed on the circuit board for being electrically connected with the first engaging structure, having a second engaging structure for engaging with the first engaging structure, and having a securing structure thereof for fixing and securing the plug, and a housing for fixedly mounting the plug.

In accordance with the present invention, the securing structure includes two semicircular elastic structures.

According to another aspect of the present invention, an adaptor assembly, comprises: a circuit board, a plug with a conductive terminal having a first engaging structure, a securing structure fixed on the circuit board for being electrically connected with the conductive terminal and having a pair of symmetrical elastic pieces, wherein the conductive terminal passes between the elastic pieces to be tightly clipped thereby, and a housing for fixedly mounting the conductive terminal.

The foregoing and other features and advantages of the present invention will be more clearly understood through the following descriptions with reference to the drawings, wherein:

DETAILED DESCRIPTION OF THE PREFERRED EMBODIMENT

Figure 1:
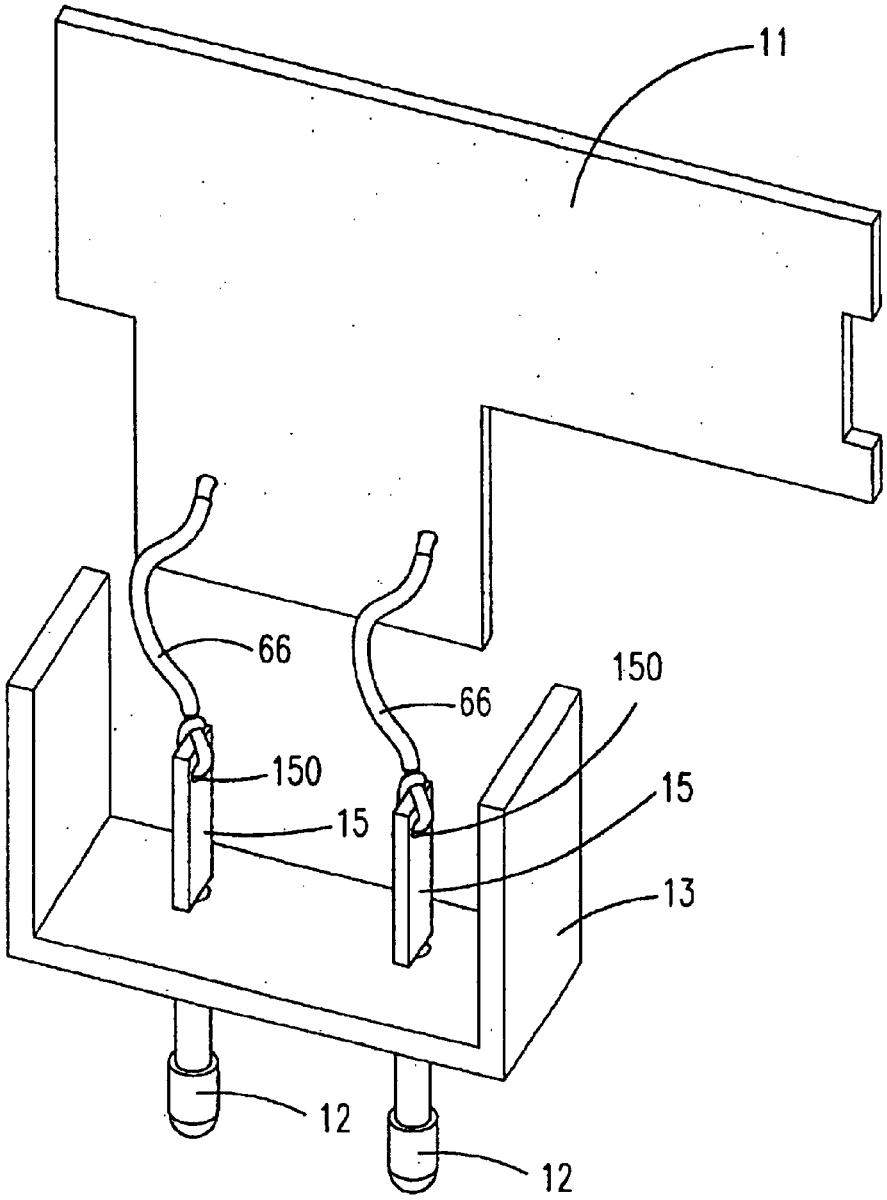
Fig. 1 (PRIOR ART)
FIG. 1 is a diagram illustrating the conventional adaptor assembly structure according to the prior art.
Figure 2:
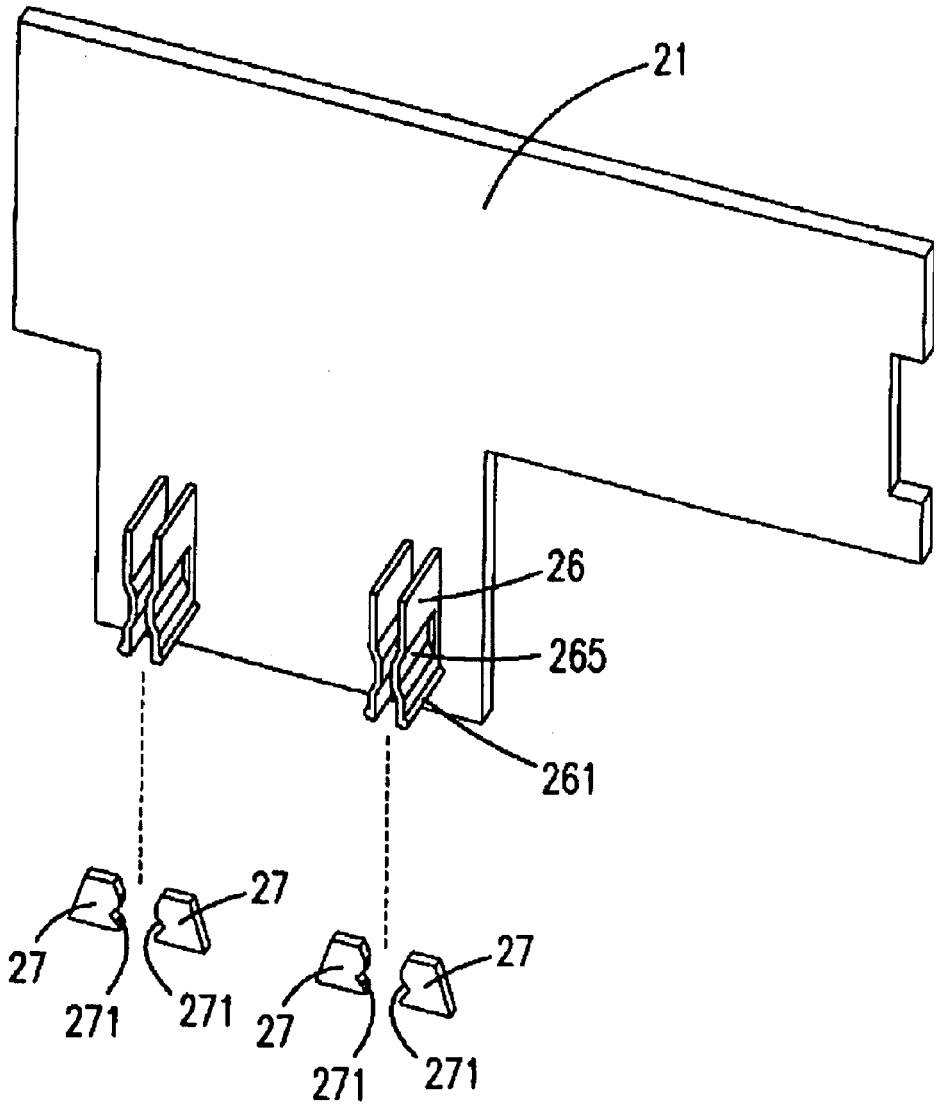
FIG. 2 is a diagram illustrating the securing mechanism in the adaptor assembly structure according to a preferred embodiment of the present invention.
Figure 3:
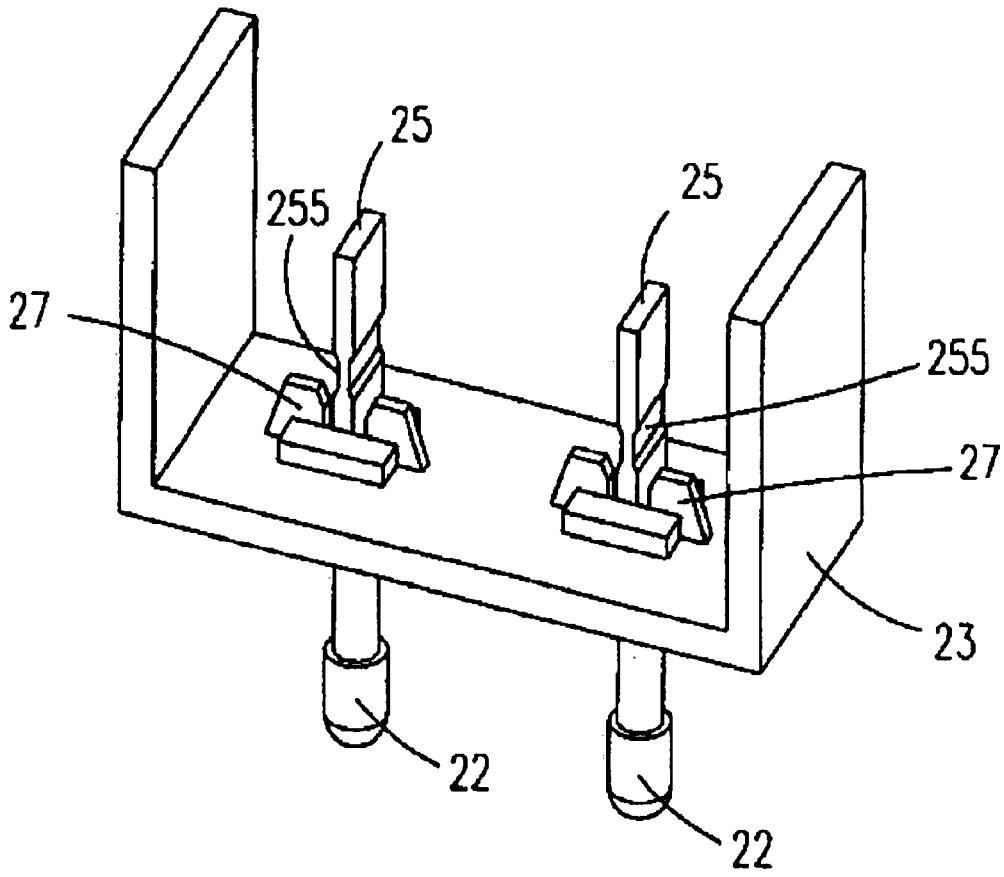
FIG. 3 is a diagram illustrating the securing mechanism in the adaptor assembly structure according to a preferred embodiment of the present invention.
Figure 4:
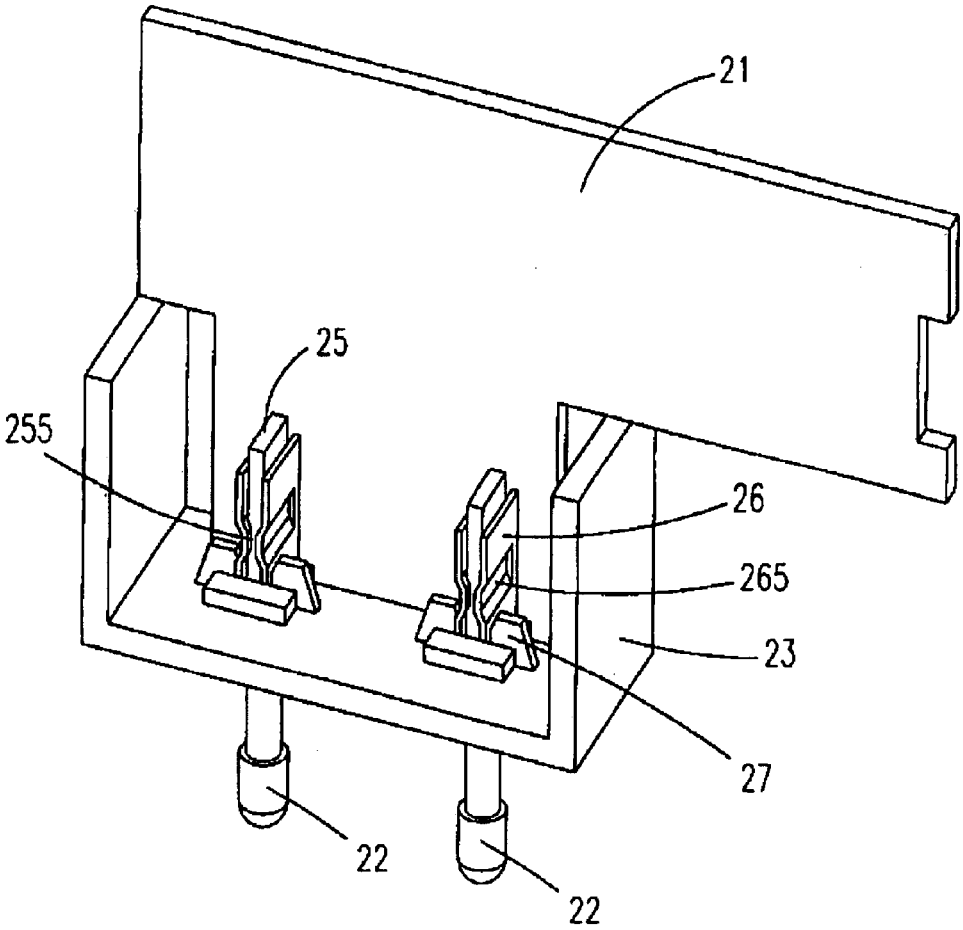
FIG. 4 is a diagram illustrating the adaptor assembly structure according to a preferred embodiment of the present invention.

The present invention will now described more specifically with reference to the following embodiments. Please refer to FIG. 2–4. FIG. 2 is a diagram illustrating the securing mechanism in the adaptor assembly structure according to a preferred embodiment of the present invention. FIG. 3 is a diagram illustrating the securing mechanism in the adaptor assembly structure according to a preferred embodiment of the present invention. FIG. 4 is a diagram illustrating the adaptor assembly structure according to a preferred embodiment of the present invention. The adaptor basically includes a housing 23, a plug 22, and a printed circuit board 21. The plug 22 is used for electrically connecting with the external power supply. The printed circuit board 21 has different electrical elements or devices mounted thereon (not disclosed) in response to the different functions of different adaptors. According to the different purposes of different adaptors, the printed circuit board 21 can commutate the electric current and transform the current for directly usage, for example, a power supply, an electrical adaptor, or a charger. Since the application principle is as same as the prior art, it is not described repeatedly here. The plug 22 mainly includes at least two conductive terminals 25. Each conductive terminal 25 has a first engaging structure 255 at one end as shown in FIG. 3. The plug 22 could be made as a flat piece or a column based on different standards in different countries. In the present embodiment, the plug 22 has two conductive terminals 25 with the column shape, which are used as the alternating current pins (Ac pins). Moreover, a securing structure 26 is fixed to the printed circuit board 21 for being electrically connected with the conductive terminal 25. The securing structure 26 has a second engaging structure 265 as shown in FIG. 3, which is used for being electrically connected and engaging with the first engaging structure 255. Furthermore, the housing 23 has two insertion holes for inserting and fixedly mounting the conductive terminals 25 thereon.

Figure 8:
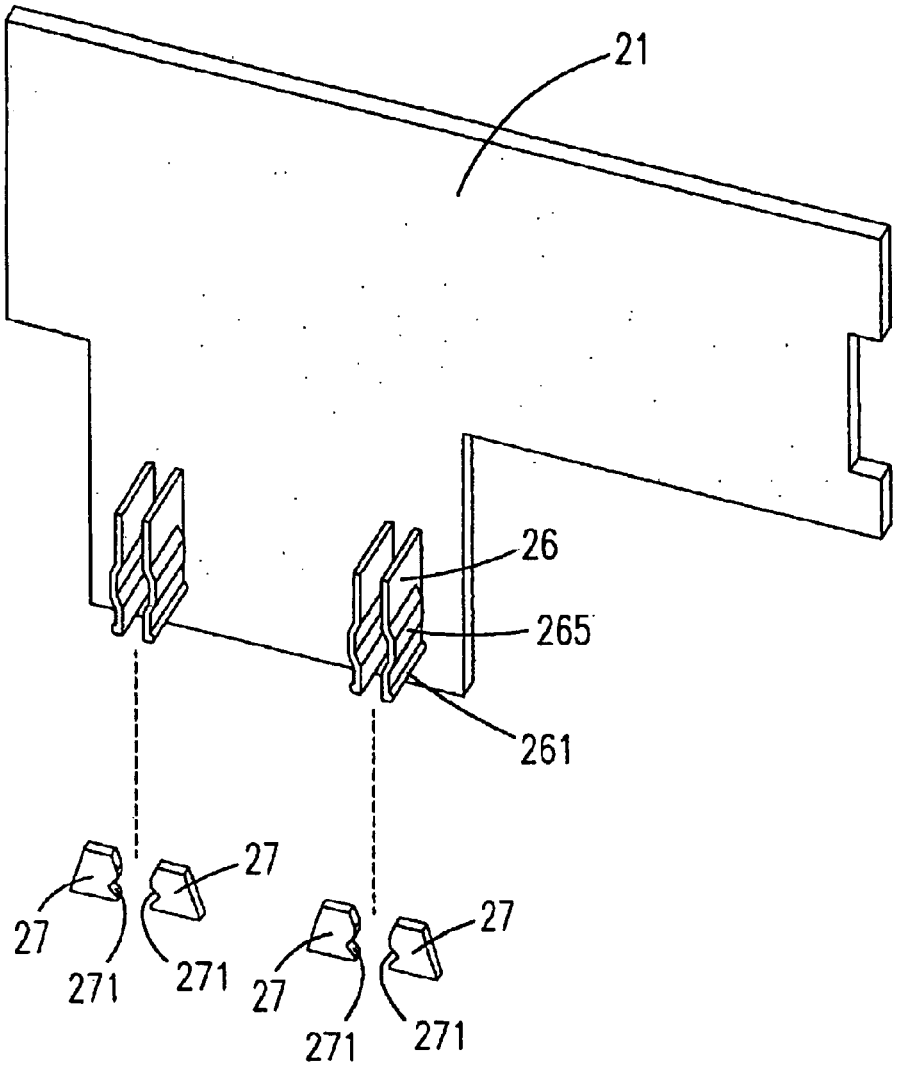
Figure 9:
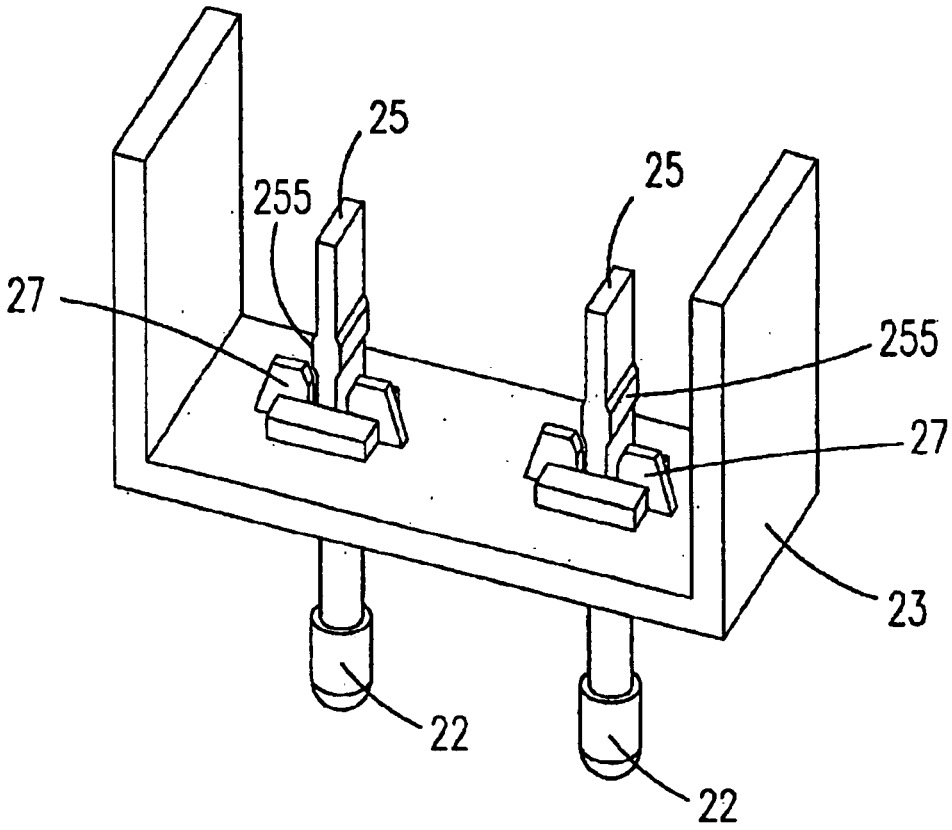

The characteristic of the present invention is that the power connecting cord, which occupies a large space inside the adaptor, is not necessary anymore for connecting the conductive terminal 25 and the printed circuit board 21. Please refer to FIGS. 2–3. The conductive terminal 25 and the securing structure 26 have the first engaging structure 255 and the second engaging structure 265 respectively. The structural shapes of the first engaging structure 255 and the second engaging structure 265 are actually corresponding and complementary. Also, the securing structure 26 includes a pair of elastic pieces having symmetrical structures. Therefore, the first engaging structure 255 and the second engaging structure 265 are able to connect and engage with each other by the corresponding shape and the elasticity of the elastic pieces. In other words, when the first engaging structure 255 is an indentation structure, the second engaging structure 265 of the securing structure 26 is a protrudent structure, as shown in FIGS. 2–3. When the first engaging structure 255 is a protrudent structure, the second engaging structure 265 of the securing structure 26 is an indentation structure, as shown in FIGS. 8–9. While the first engaging structure 255 and the second engaging structure 265 are mutually connected and engaged with each other by the corresponding shape, not only the electrical connection is achieved, but also the integral structure is fixed by the securing mechanism so that the connection and the engagement won't be detached.

In addition, according to a preferred embodiment in the present invention, the housing 23 further comprises a flank structure 27 as shown in FIGS. 2–3. The housing 23 and the flank structure 27 are integrally formed. The flank structure 27 has a wedging indentation 271 for tightly wedging therein the securing structure 26 so that the securing structure 26 is tightly secured to the housing 23. Furthermore, the securing structure 26 further includes a bulge 261, which is positioned at the corresponded position of the wedging indentation 271 of the flank structure 27. Therefore, the bulge 261 is wedged in the wedged indentation 271 so that the securing structure 26 is fixed to the housing 23.

According to the above description, it is very easy and fast to assembly the adaptor in the present invention. Please refer to FIG. 4. Only one time insertion is needed during the assembly process, which is either pushing upwards the housing 23 and the conductive terminals 25 mounted thereon, or pushing downwards the printed circuit board 21 and the securing structure 26 fixed thereto. After insertion, the first engaging structure 255 and the second engaging structure 265 are fixed and secured with each other. In such a way, not only the electrical connection is provided, but also the engagement between the conductive terminal 25 and the securing structure 26 is fixed. In addition, in order to enhance the connection between the housing 23 and the securing structure 26, the wedging indentation 271 of the flank structure 27 and the bulge 261 of the securing structure 26 are wedged with each other after insertion so that the securing structure 26 is tightly secured and fixed. Therefore, the adaptor provided in the present invention saves lots of space occupied by the power connecting cord. Besides, the assembly process for the adaptor needs only one time insertion without the need of the welding process, which saves lots of time and energy.

Figure 5:
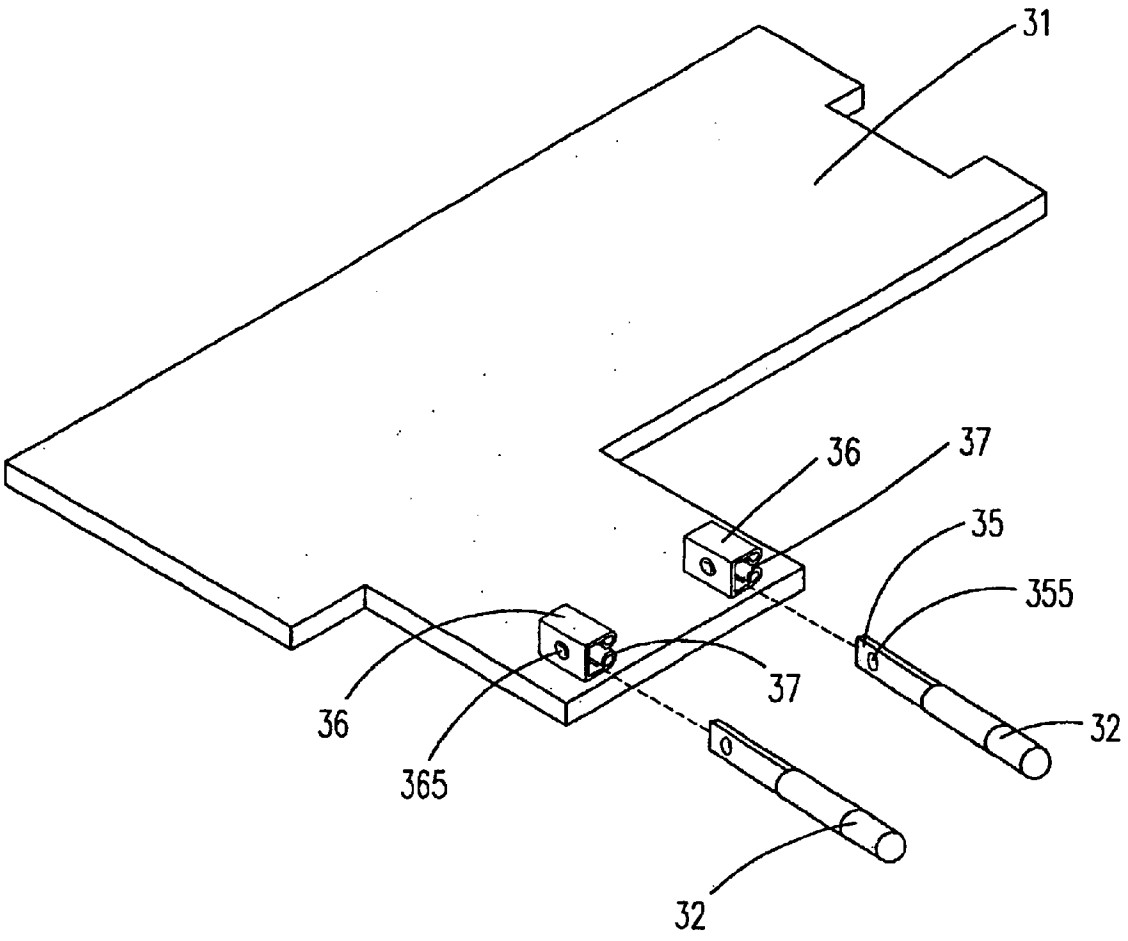
FIG. 5 is a diagram illustrating the adaptor assembly structure according to another preferred embodiment of the present invention.

Please refer FIG. 5. FIG. 5 is a diagram illustrating the adaptor assembly structure according to another preferred embodiment of the present invention. This embodiment is similar to the former one as shown in FIG. 4. However, the securing structure 26 and the flank structure 27 in the former embodiment are changed into the retaining structure 36 in the present embodiment. Similarly, the conductive terminal 35 has a first engaging structure 355 at one end as shown in FIG. 5. The retaining structure 36 is fixed on the printed circuit board 31 for being electrically connected with the conductive terminal 35. The retaining structure 36 has a second engaging structure 365 for engaging with the first engaging structure 355. Similarly, the first engaging structure 355 and the second engaging structure 365 are mutually connected and engaged with each other by the corresponding structural shape. Not only the electrical connection is achieved, but also the integral structure is fixed by the securing mechanism so that the connection and the engagement won't be detached. Furthermore, the retaining structure 36 includes a securing structure 37 for fixing and securing the conductive terminal 35. The securing structure 37 includes two semicircular elastic structures. When the conductive terminal 35 is inserted into the securing structure 37, the elasticity of the semicircular structures will make the conductive terminal 35 secured and fixed at a certain position.

Figure 6:
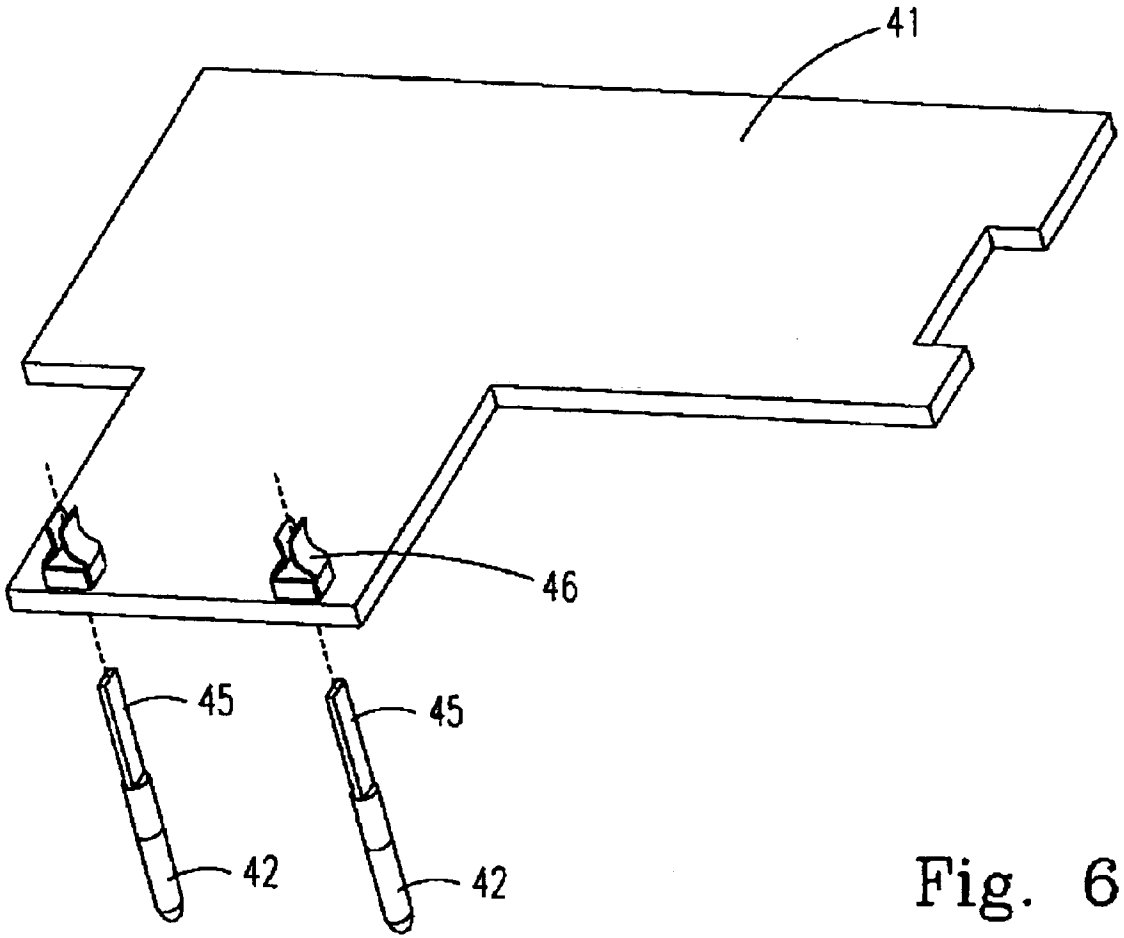
FIG. 6 is a diagram illustrating the adaptor assembly structure according to another preferred embodiment of the present invention.
Figure 7:
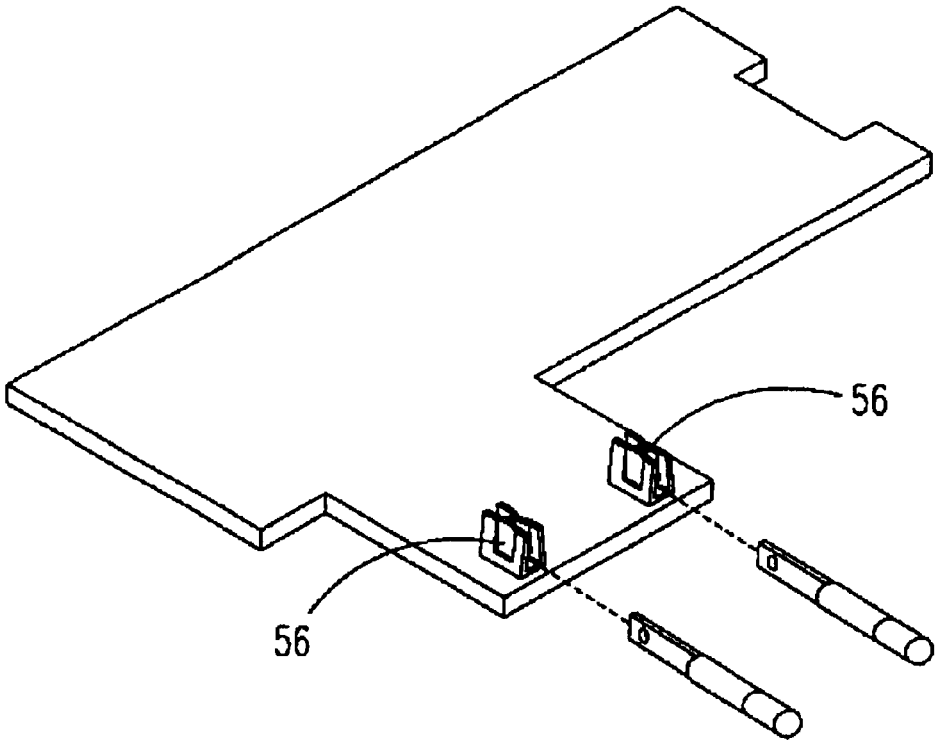
FIG. 7 is a diagram illustrating the adaptor assembly structure according to another preferred embodiment of the present invention.

Please refer to FIG. 6. FIG. 6 is a diagram illustrating the adaptor assembly structure according to another preferred embodiment of the present invention. This embodiment is similar to the previous embodiments. The securing structure 46 is fixed on the printed circuit board 41 for being electrically connected with the conductive terminal 45. The securing structure 46 has a pair of symmetrical elastic pieces. When the conductive terminal 45 is inserted between the pair of symmetrical elastic pieces, the elasticity of the elastic pieces will make the conductive terminal 45 secured and fixed at a certain position. Please refer to FIG. 7. FIG. 7 is a diagram illustrating the adaptor assembly structure according to another preferred embodiment of the present invention. The structure and the principle of the adaptor in FIG. 7 are similar to those of FIG. 6. Only that the shape of the securing structure 56 is slightly different compared to the adaptor in FIG. 6.

According to the above, the drawbacks in the conventional adaptor are not existed in the adaptor provided in the present invention. First, the conductive terminal and the printed circuit board are connected directly without the need of the power connecting cord, which occupies lots of space inside the adaptor. Secondly, the conductive terminal and the printed circuit board are connected and engaged with each other by the corresponding structural shape and the elasticity of the elastic structure. Moreover, the electrical connection is accomplished by the particular engaging structures. Thirdly, lots of space is saved since the power connecting cord is not needed. Furthermore, the assembly process for the adaptor needs only one time insertion without the need of the welding process, which saves lots of time and energy. Hence, the present invention not only has a novelty and a progressive nature, but also has an industry utility.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An adaptor assembly, comprising:

a circuit board;

a plug having a first engaging structure;

a securing structure fixed to said circuit board and having a second engaging structure for being electrically connected and engaging with said first engaging structure; and a housing for fixedly mounting thereon said plug and comprising a flank structure having a wedging indentation for tightly wedging therein said securing structure so that said securing structure is tightly secured to said housing, wherein said securing structure further comprises a bulge wedged in said wedged indentation for fixing said securing structure.

2. The adaptor assembly according to claim 1, wherein said circuit board is a printed circuit board.

3. The adaptor assembly according to claim 1, wherein said plug comprises at least two said conductive terminals having said first engaging structure.

4. The adaptor assembly according to claim 1, wherein said housing and said flank structure are integrally formed.

5. The adaptor assembly according to claim 1, wherein said first engaging structure is a protrudent structure, and said second engaging structure of said securing structure is an indentation structure.

6. The adaptor assembly according to claim 1, wherein said first engaging structure is an indentation structure, and said second engaging structure of said securing structure is a protrudent structure.

7. The adaptor assembly according to claim 1, wherein said securing structure includes a pair of elastic pieces having symmetrical structures.

8. The adaptor assembly according to claim 1, wherein said first engaging structure is a conductive terminal.

9. The adaptor assembly according to claim 8, wherein said conductive terminal is an alternating current pin (AC pin).

10. The adaptor assembly according to claim 8, wherein said housing has an insertion hole for inserting and fixedly mounting said conductive terminal thereon.

11. The adaptor assembly according to claim 1, wherein said adaptor is a power adaptor.

12. The adaptor assembly according to claim 1, wherein said adaptor is a power supply.

13. The adaptor assembly according to claim 1, wherein said adaptor is a charger.

14. An adaptor assembly, comprising:

a circuit board;

a plug having a first engaging structure;

a retaining structure fixed on said circuit board for being electrically connected with said first engaging structure, having a second engaging structure for engaging with said first engaging structure, and having a securing structure thereof for fixing and securing said plug; and a housing for fixedly mounting said plug and comprising a flank structure having a wedging indentation for tightly wedging therein said retaining structure so that said retaining structure is tightly secured to said housing, wherein said retaining structure further comprises a bulge wedged in said wedged indentation for fixing said securing structure.

15. The adaptor assembly according to claim 14, wherein said securing structure includes two semicircular elastic structures.

16. An adaptor assembly, comprising:

a circuit board;

a plug with a conductive terminal having a first engaging structure;

a securing structure fixed on said circuit board for being electrically connected with said conductive terminal and having a pair of symmetrical elastic pieces, wherein said conductive terminal passes between said elastic pieces to be tightly clipped thereby; and a housing for fixedly mounting said conductive terminal and comprising a flank structure having a wedging indentation for tightly wedging therein said securing structure so that said securing structure is tightly secured to said housing, wherein said securing structure further comprises a bulge wedged in said wedged indentation for fixing said securing structure.

* * * * *